United States Patent [19]

Amaki et al.

[11] 4,208,843

[45] Jun. 24, 1980

[54] GRINDING ATTACHMENT FOR PORCELAIN BODIES

[75] Inventors: Takashi Amaki; Mitsutoshi Mamiya, both of Aichi, Japan

[73] Assignee: NGK Insulators, Ltd., Nagoya, Japan

[21] Appl. No.: 934,871

[22] Filed: Aug. 18, 1978

[30] Foreign Application Priority Data

Aug. 27, 1977 [JP] Japan ..... 52-114796[U]

[51] Int. Cl.[2] ..... B24D 5/14

[52] U.S. Cl. ..... 51/207; 51/206 R

[58] Field of Search ..... 51/168, 206 R, 206 P, 51/206 NF, 206.4, 206.5, 207; 407/43, 56, 65

[56] References Cited

U.S. PATENT DOCUMENTS

| | | | |
|---|---|---|---|
| 1,469,723 | 10/1923 | Greenwood | 51/207 X |
| 2,244,057 | 6/1941 | Ekholm | 51/168 |
| 2,769,286 | 11/1956 | Beth | 51/206.4 |
| 3,201,902 | 8/1965 | Benson | 51/206 R |
| 3,376,673 | 4/1968 | Metzger | 51/168 |
| 3,585,761 | 6/1971 | Hughes | 51/207 |

FOREIGN PATENT DOCUMENTS

| | | | |
|---|---|---|---|
| 226842 | 10/1910 | Fed. Rep. of Germany | 51/207 |
| 278721 | 11/1970 | U.S.S.R. | 51/206 R |

*Primary Examiner*—Gary L. Smith

*Attorney, Agent, or Firm*—Norbert P. Holler; Philip Rodman

[57] ABSTRACT

A grinding attachment for porcelain bodies, comprising a rotary shaft having a flange and an externally threaded end portion; a plurality of groups of grinding wheels concentrically mounted on said rotary shaft and clamped between said flange and nut, said each grinding wheel in the respective groups including a support disk and a plurality of grindstone pieces equidistantly mounted on a circumferential end surface of said support disk and having their arcuate end surfaces disposed on one and the same circumferential surface, said grinding wheels being mounted on the rotary shaft in such a manner that the grind-stone pieces on the respective grinding wheels alternate with the grindstone pieces on adjacent grinding wheels in the circumferential direction.

1 Claim, 4 Drawing Figures

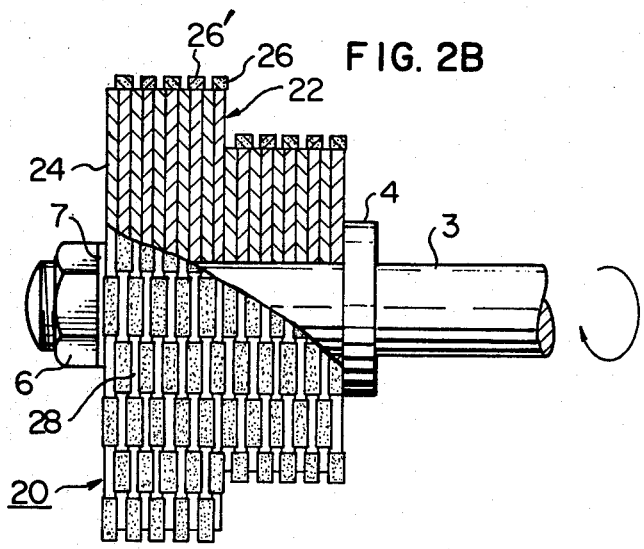
FIG. 2B
FIG. 3
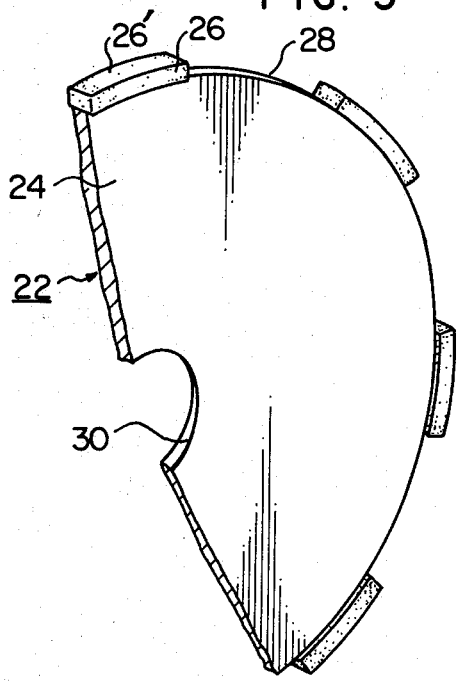

GRINDING ATTACHMENT FOR PORCELAIN BODIES

BACKGROUND OF THE INVENTION

The present invention relates to a device for grinding and finishing fired porcelain bodies into given profiles.

Large-sized products such as porcelain bushing shells for which dimensional accuracy is generally required are beforehand made rather large in consideration of shrinkage during forming from clay material, drying and firing, and are ground after firing to be finished to given dimensions. This grinding is usually effected by grindstones whose contours conform with the finished shape of the product. Heretofore, the grindstones of the type described have been subjected to large grinding resistance, and have been low in grinding efficiency. In addition, these grindstones have various disadvantages in that the grinding surfaces are subject to loading with grinding dust in a short period of time to thereby make it impossible to effect continuous grinding work for a long period of time, and that once loading occurs, dressing work for removing such loading requires advanced skill and much labor.

SUMMARY OF THE INVENTION

The present invention provides a grinding attachment for porcelain bodies; comprising a rotary shaft and a plurality of grinding wheel, said grinding wheel including a circular support disk and a plurality of grindstone pieces mounted on a peripheral end surface of the support disk in spaced relation with one another and having their arcuate end surface disposed on one and the same circumferential surface.

An object of the present invention is to provide a grinding attachment for porcelain bodies, which is subject to small grinding resistance and is free from loading with grinding dust.

Another object of the present invention is to provide a grinding attachment for porcelain bodies which has a high efficiency and is free from any grinding uneveness.

Further object of the present invention is to provide a grinding attachment for porcelain bodies, which is inexpensive and by which products of desired shape can be readily obtained.

DESCRIPTION OF THE DRAWINGS

FIG. 2B is a fragmentary enlarged side view showing the grinding attachment of FIG. 2A; and FIG. 3 is a fragmentary perspective view showing a circular grinding wheel which constitutes a unit of the grinding attachment shown in FIGS. 2A and 2B.

DESCRIPTION OF THE PREFERRED EMBODIMENT

Figure 1:
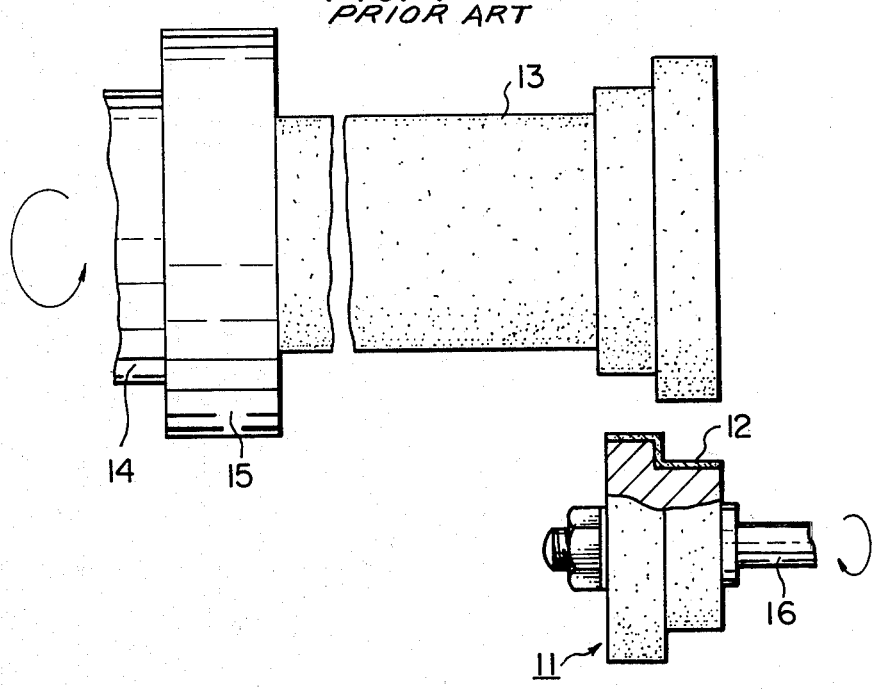
FIG. 1 PRIOR ART
FIG. 1 is a fragmentary side view showing an example of a conventional grinding attachment and a porcelain body to be ground.

Referring to FIG. 1, there are shown a porcelain body (13) and a conventional grinding attachment (11). The grinding attachment (11) consists of a body of grindstone having a grinding surface (12), and is secured to a rotary shaft (16) to be rotated therewith by a driving device (not shown). The porcelain body (13) is secured on the rotary shaft (14) by means of a chuck

(15) to be rotated therewith. The grinding surface (12) extending over the surface of grindstone is in the form of continuous stepped cylindrical surfaces. Thus the porcelain body (13) is subjected to grinding by pressing the grinding attachment (11) thereagainst with the rotary shafts (14, 16) rotated in the opposite direction, the grinding resistance becomes large and the grinding surface (12) is subject to loading in a short period of time.

Figure 2A:
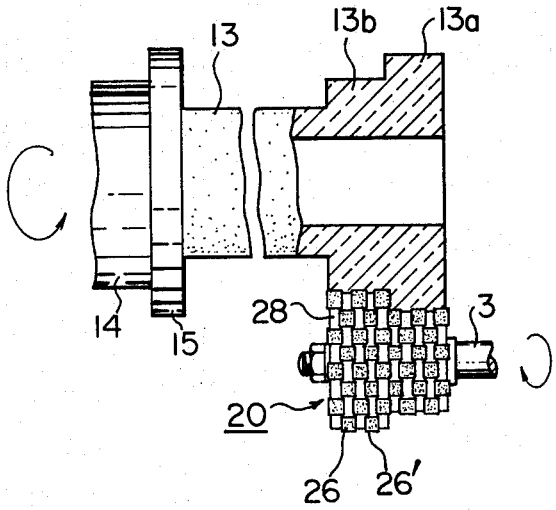
FIG. 2A is a fragmentary side view showing a grinding attachment according to the present invention in use for grinding a porcelain body.

FIGS. 2A, 2B and 3 show an embodiment according to the present invention. In the drawings, the same parts as shown in FIG. 1 are designated by like reference numerals. Generally designated by the numeral (20) is a grinding attachment which is rotated by a driving mechanism connected to a suitable driving power source. The driving mechanism includes a rotary shaft (3), a nut (6) and a stopper (7). The rotary shaft (3) includes a flange (4) of enlarged diameter, and is externally threaded at its one end to receive the nut (6).

The grinding attachment (20) comprises a plurality of grinding wheels (22) each including a support disk (24) formed with a hole (30) as shown in FIG. 3 and grindstone pieces (26) equidistantly mounted on the circumferential end surface of the support disk. Defined between adjacent grindstone pieces (26) are arcuate-shaped spaces (28) each having a slightly larger length than that of the grindstone piece (26) in the circumferential direction. Thus in assembling a plurality of grinding wheels on the rotary shaft, said each arcuate space (28) receives the grindstone piece (26) of the adjacent grinding wheel. The grindstone piece (26) is formed by mixing abrasive grains of diamond, silicon carbide and the like with a binder, and firing the resulting body. The piece (26) is of arcuately curved rectangular shape, and its arcuate end surface (26') is adapted to extend over one and the same cylindrical surface when assembled. The width of the grindstone piece is made slightly larger than the thickness of the support disk (24), so that the piece overlaps the piece of the adjacent grinding wheel in the axial direction when assembled. In the embodiment shown, the grinding attachment comprises two groups of grinding wheels, one group of which consists of ten grinding wheels each having a diameter of 400 mm and a thickness of 5 mm and the other group of which consists of ten grinding wheels each having a diameter of 300 mm and a thickness of 5 mm. These groups of grinding wheels are stacked to be concentrically mounted on the rotary shaft (3), and the shape defined by the arcuate end surfaces of all grinding wheels conforms with the finished shape of a porcelain body.

It should be understood that the contour of the grinding attachment is not limited to that shown, but is suitably changed in accordance with the finished shape of the porcelain body.

In operation, the intermediate portion of a porcelain body (13), such as a porcelain bushing shell, having two-stepped flange portions (13*a*), (13*b*) at its one end is fixed on the rotary shaft (14) by means of a chuck (15) to be rotated therewith, and simultaneously, the rotary shaft (3) is rotated. Then the rotary shaft (3) is translated to press the grinding attachment (20) against the stepped portions (13*a*, 13*b*) of the porcelain body (13) having a contour substantially corresponding to that of the grinding attachment, and the outer peripheral surface of the porcelain body is ground by a plurality of grindstone pieces (26) mounted on the outer peripheral surface of the grinding attachment (20). Grinding effected by the grindstone pieces (26) produces a small grinding resistance as compared with grinding effected by the conventional grinding attachment (11). In addition, the grinding dust enters spaces defined between the adjacent grindstone pieces (26), and is removed therefrom by a centrifugal force due to the rotation of the grinding attachment (20). Therefore the grinding surfaces of the grindstone pieces (26), that is, the arcuate end surfaces (26') are not subject to loading with the grinding dust at all, so that the outer peripheral surface of the porcelain body (13) to be ground is ground by the plurality of grindstone pieces (26) to be very efficiently ground in a short period of time. Furthermore the grindstone pieces (26) mounted on the outer peripheral end surface of the support disk (24) of the respective grinding wheel (22) overlap the grindstone pieces mounted on the adjacent support disk in the axial direction. By this arrangement, there is no tendency of producing any grinding uneveness or any linear portions free from grinding on the ground surface of the porcelain body (13), so that a smoothly finished surface can be obtained to eliminate any necessity of finishing work on the surface. That is, grinding is completed in a single process to make grinding work very efficient.

According to the present invention, the arcuate end surface (26') occupying part of the entire outer peripheral surface of the grinding attachment (20) serves as a grinding surface, and so the grinding resistance is so small as to reduce energy consumption, there is produced little loading to eliminate frequent dressing, thereby improving the operating efficiency of grinding. There are presented further advantages in that smooth and uniform finished surface can be obtained to eliminate any repeated finishing work.

The grinding attachment according to the present invention is constructed such that a multiplicity of grinding wheels (22) are stacked and clamped. So, preparation and suitable selection of grinding wheels of different diameters provides a grinding attachment having a desired profiles. Accordingly, the manufacturing cost of the grinding attachment becomes low, and considerable economics are effected. It is to be understood that the present invention is not limited to the specific form of the embodiment with which reference is made, but is defined only by the appended claims.

What is claimed is:

1. A grinding attachment for porcelain bodies, comprising a rotary shaft and a plurality of grinding wheels concentrically mounted on said rotary shaft, each grinding wheel of the grinding wheels including a circular support disk and a plurality of grindstone pieces secured on the peripheral surface of said support disk in spaced relation with one another and having their arcuate end surfaces extended on one and the same circumferential surface, with the width of the grindstone pieces being slightly larger than the thickness of the support disk, said grinding wheels being arranged so that the grindstone pieces of one wheel overlap the spaces between the grindstone pieces secured on the adjacent grinding wheels in the axial direction when assembled.

* * * * *